US009097059B1

(12) United States Patent
Flynn et al.

(10) Patent No.: US 9,097,059 B1
(45) Date of Patent: Aug. 4, 2015

(54) DRAINING SILL AND FRAME ASSEMBLY INCORPORATING THE SAME

(71) Applicant: Andersen Corporation, Bayport, MN (US)

(72) Inventors: John Scott Flynn, Temecula, CA (US); Richard Lee Lang, San Marcos, CA (US)

(73) Assignee: ANDERSEN CORPORATION, Bayport, MN (US)

( * ) Notice: Subject to any disclaimer, the term of this patent is extended or adjusted under 35 U.S.C. 154(b) by 0 days.

(21) Appl. No.: 14/267,293

(22) Filed: May 1, 2014

(51) Int. Cl.
*E06B 1/04* (2006.01)
*E06B 7/14* (2006.01)

(52) U.S. Cl.
CPC ..... *E06B 7/14* (2013.01)

(58) Field of Classification Search
CPC ..... E06B 7/14
USPC ..... 49/408, 467, 471; 52/209
See application file for complete search history.

(56) References Cited

U.S. PATENT DOCUMENTS

| | | | | |
|---|---|---|---|---|
| 192,432 | A | 6/1877 | Hamor | |
| 204,006 | A | 5/1878 | Condict, Jr. | |
| 364,434 | A | 6/1887 | Pitmon | |
| 635,656 | A | 10/1899 | Chastain | |
| 2,108,137 | A | 2/1938 | Oftedal et al. | |
| 2,570,336 | A | 10/1951 | Fouts | |
| 2,856,040 | A | 10/1958 | Dansereau | |
| 3,410,027 | A * | 11/1968 | Bates | 49/471 |
| 3,491,400 | A | 1/1970 | Hubbard | |
| 3,555,736 | A | 1/1971 | Koch, Jr. et al. | |
| 3,636,660 | A | 1/1972 | Peterson | |
| 3,845,599 | A * | 11/1974 | Jolly | 52/209 |
| 3,938,621 | A | 2/1976 | Bobbitt, Jr. | |
| 4,003,171 | A | 1/1977 | Mitchell | |
| 4,073,035 | A | 2/1978 | Baus | |
| 4,125,141 | A | 11/1978 | Stillwell | |
| 4,208,755 | A | 6/1980 | Shepherd | |
| 4,310,991 | A * | 1/1982 | Seely | 49/470 |
| 4,358,863 | A | 11/1982 | Jacobsen | |
| 5,067,279 | A * | 11/1991 | Hagemeyer | 49/471 |
| 5,123,212 | A * | 6/1992 | Dallaire et al. | 52/209 |
| 5,136,814 | A | 8/1992 | Headrick | |
| 5,179,804 | A | 1/1993 | Young | |
| 5,212,921 | A | 5/1993 | Unruh | |
| 5,341,600 | A | 8/1994 | Heppner | |
| 5,671,501 | A | 9/1997 | Laramie | |
| 5,826,387 | A | 10/1998 | Henderson et al. | |
| 5,956,909 | A | 9/1999 | Chou | |
| 6,170,207 | B1 | 1/2001 | Saindon | |

(Continued)

FOREIGN PATENT DOCUMENTS

| | | |
|---|---|---|
| AU | 771413 B2 | 3/2004 |
| CA | 2 428 220 A1 | 12/2003 |

(Continued)

*Primary Examiner* — Jerry Redman
(74) *Attorney, Agent, or Firm* — Mueting, Raasch & Gebhardt, P.A.

(57) ABSTRACT

Draining sills, frame assemblies incorporating the draining sills, and methods of using the same are described herein. The draining sills include a primary drain channel and one or more shorter auxiliary channels to capture and control water passing over the sill. The auxiliary channels provide additional fluid control capability to the draining sills which may be useful in locations where the flow rate of water passing over the sill may be increased.

39 Claims, 10 Drawing Sheets

(56) References Cited

U.S. PATENT DOCUMENTS

| | | | | |
|---|---|---|---|---|
| 6,216,405 | B1 | 4/2001 | Smith | |
| 6,371,188 | B1 | 4/2002 | Baczuk et al. | |
| 6,381,911 | B1 | 5/2002 | Weiland | |
| 6,619,004 | B2 | 9/2003 | Loper | |
| 6,792,651 | B2 | 9/2004 | Weiland et al. | |
| 7,007,343 | B2 | 3/2006 | Weiland et al. | |
| 7,574,829 | B1 * | 8/2009 | Prager | 49/408 |
| 7,591,106 | B2 | 9/2009 | Conlin | |
| 7,669,369 | B2 | 3/2010 | Henry et al. | |
| 7,877,945 | B2 | 2/2011 | Eggen et al. | |
| 8,065,839 | B2 | 11/2011 | Conlin | |
| 8,132,370 | B2 | 3/2012 | Heppner | |
| 8,448,384 | B2 | 5/2013 | Wernlund et al. | |
| 8,458,968 | B2 | 6/2013 | Shoshan | |
| 8,499,498 | B2 | 8/2013 | Heppner | |
| 8,533,997 | B2 | 9/2013 | Stoutenborough et al. | |
| 2002/0053169 | A1 | 5/2002 | Menuzzo | |
| 2003/0177699 | A1 * | 9/2003 | Fukuro et al. | 49/408 |
| 2004/0163317 | A1 | 8/2004 | Reich et al. | |
| 2005/0005395 | A1 | 1/2005 | Weiland et al. | |
| 2005/0262782 | A1 | 12/2005 | Harrison et al. | |
| 2006/0096061 | A1 | 5/2006 | Weiland et al. | |
| 2006/0150521 | A1 * | 7/2006 | Henry et al. | 49/471 |
| 2006/0174545 | A1 * | 8/2006 | Young | 49/468 |
| 2007/0119549 | A1 | 5/2007 | Weiland | |
| 2007/0271850 | A1 | 11/2007 | Mickelson | |
| 2008/0110100 | A1 * | 5/2008 | Heppner | 49/471 |
| 2010/0300001 | A1 * | 12/2010 | Wernlund et al. | 49/471 |
| 2012/0124909 | A1 | 5/2012 | Koch et al. | |
| 2012/0159853 | A1 | 6/2012 | Mickelson et al. | |
| 2013/0199100 | A1 * | 8/2013 | Van Camp et al. | 49/468 |
| 2013/0212962 | A1 * | 8/2013 | Hughes et al. | 52/209 |
| 2014/0041326 | A1 * | 2/2014 | Kadavy et al. | 52/209 |
| 2014/0260011 | A1 * | 9/2014 | Pettibone | 52/209 |
| 2014/0318020 | A1 * | 10/2014 | Van Camp et al. | 49/468 |

FOREIGN PATENT DOCUMENTS

| | | | | |
|---|---|---|---|---|
| CA | 2 428 220 | C | 6/2007 | |
| DE | 36 00 133 | C1 | 1/1987 | |
| EP | 0 904 721 | A1 | 3/1999 | |
| EP | 1 375 804 | A3 | 9/2006 | |
| EP | 1 375 804 | B1 | 11/2009 | |
| EP | 2362057 | A2 * | 8/2011 | E06B 7/14 |
| GB | 1 537 347 | A | 12/1978 | |
| GB | 2128666 | A * | 5/1984 | E06B 7/14 |
| GB | 2180871 | A * | 4/1987 | E06B 7/14 |
| JP | H 04336191 | A | 11/1992 | |
| JP | H 05214880 | A | 8/1993 | |
| JP | H 0828144 | A | 1/1996 | |
| JP | H 08199927 | A | 8/1996 | |
| JP | 2000 129741 | A | 5/2000 | |
| JP | 2000 129742 | A | 5/2000 | |
| JP | 2000 212915 | A | 8/2000 | |
| WO | WO 2008/156696 | A1 | 12/2008 | |

* cited by examiner

DRAINING SILL AND FRAME ASSEMBLY INCORPORATING THE SAME

Draining sills and frame assemblies incorporating the draining sills are described herein.

BACKGROUND

Windows and doors are typically mounted in frames that include a sill at the bottom of the opening in which the window or door is located. It is desirable to limit the passage of water through the window or door when it is closed. That goal is, however, often complicated by a competing interest in providing a sill that has minimal impact on passageway through the opening in which the window or door is located. In particular, in many situations it may be desirable to provide a sill that presents a low profile to allow the passageway of wheeled traffic such as, e.g., wheelchairs, carts, etc.

SUMMARY

Draining sills, frame assemblies incorporating the draining sills, and methods of using the same are described herein.

The draining sills described herein include a primary drain channel and one or more shorter auxiliary channels to capture and control water passing over the top of the sill by collecting the water in the channels. The auxiliary channels provide additional fluid control capability to the draining sills which may be useful in locations where the flow rate of water passing over the sill may be increased such as, e.g., the junction between the draining sill, a side jamb and a door or window panel in a corner of a frame assembly, as well as at the junction between, for example, the edges of two door or window panels within the frame opening such that the panels meet at an intermediate location between the side jambs within the opening formed within the frame assembly, e.g., French doors, café windows, sliding or gliding doors or windows, etc.

As described herein, water captured by the one or more auxiliary channels in one or more embodiments of the draining sills may be drained into a primary drain channel which, itself, includes one or more drain openings formed through the sill to remove water captured in the auxiliary and primary drain channels. Such a construction may, for example, simplify water management for the draining sills and frame assemblies incorporating them as described herein.

In a first aspect, one or more embodiments of the draining sills described herein may include: a primary drain channel comprising a primary channel bottom located between the top and a bottom of the draining sill, wherein the primary drain channel extends from a first location proximate a first end of the draining sill to a second location proximate a second end of the draining sill, and wherein the primary drain channel is located between an exterior edge and an interior edge of the draining sill; a plurality of drain openings extending through the draining sill within the primary drain channel, wherein each drain opening of the plurality of drain openings extends through the bottom of the draining sill; and a first auxiliary channel located between the exterior edge of the draining sill and the primary drain channel, wherein the first auxiliary channel terminates at a first auxiliary channel terminus configured to drain fluid in the first auxiliary channel into the primary drain channel, wherein the first auxiliary channel terminus is located between the first location of the primary drain channel and the second location of the primary drain channel, and wherein the first auxiliary channel terminus is located closer to the first end than the second end of the draining sill, and further wherein the first auxiliary channel extends from the first auxiliary channel terminus towards the first end of the draining sill.

In one or more embodiments of the draining sills described herein, the first location of the primary drain channel is spaced apart from the first end of the draining sill, and wherein the first location is located between the first auxiliary channel terminus and the first end along the length of the draining sill.

In one or more embodiments of the draining sills described herein, the first auxiliary channel terminus is located above the primary drain channel.

In one or more embodiments of the draining sills described herein, the first auxiliary channel comprises a depth measured from the top of the draining sill that decreases when moving along the first auxiliary channel from the first auxiliary channel terminus towards the first end of the draining sill.

In one or more embodiments of the draining sills described herein, the first auxiliary channel comprises a first auxiliary channel bottom, and wherein the first auxiliary channel bottom is located closer to the top of the draining sill than the primary drain channel bottom.

In one or more embodiments of the draining sills described herein, the draining sill may include a second auxiliary channel located between the exterior edge of the draining sill and the primary drain channel, wherein the second auxiliary channel terminates at a second auxiliary channel terminus configured to drain fluid in the second auxiliary channel into the primary drain channel, wherein the second auxiliary channel extends from the second auxiliary channel terminus towards the second end of the draining sill; wherein the first auxiliary channel terminus is located between the first location of the primary drain channel and the second auxiliary channel terminus along a length of the draining sill as measured between the first end and the second end of the draining sill; and wherein the second auxiliary channel terminus is located between the second location of the primary drain channel and the first auxiliary channel terminus along the length of the draining sill.

In one or more embodiments of the draining sills described herein that include a second auxiliary channel, the second location of the primary drain channel is spaced apart from the second end of the draining sill, and wherein the second location is located between the second auxiliary channel terminus and the second end of the draining sill along the length of the draining sill.

In one or more embodiments of the draining sills described herein that include a second auxiliary channel, the second auxiliary channel terminus is located above the primary drain channel.

In one or more embodiments of the draining sills described herein that include a second auxiliary channel, the second auxiliary channel comprises a depth measured from the top of the draining sill that decreases when moving along the second auxiliary channel from the second auxiliary channel terminus towards the second end of the draining sill.

In one or more embodiments of the draining sills described herein that include a second auxiliary channel, the second auxiliary channel comprises a second auxiliary channel bottom, and wherein the second auxiliary channel bottom is located closer to the top of the draining sill than the primary drain channel bottom.

In one or more embodiments of the draining sills described herein that include a second auxiliary channel, the draining sill further comprises an intermediate auxiliary channel located between the exterior edge and the primary drain channel, and wherein the intermediate auxiliary channel comprises an intermediate auxiliary channel terminus configured to drain fluid in the intermediate auxiliary channel into the primary drain channel; wherein the intermediate auxiliary channel terminus is located between the first auxiliary channel terminus and the second auxiliary channel terminus.

In one or more embodiments of the draining sills described herein that include an intermediate auxiliary channel, the intermediate auxiliary channel terminus is located above the primary drain channel.

In one or more embodiments of the draining sills described herein that include an intermediate auxiliary channel, the intermediate auxiliary channel comprises a depth measured from the top of the draining sill that decreases when moving along the intermediate auxiliary channel away from the intermediate auxiliary channel terminus.

In one or more embodiments of the draining sills described herein that include an intermediate auxiliary channel, the intermediate auxiliary channel comprises an intermediate auxiliary channel bottom, and wherein the intermediate auxiliary channel bottom is located closer to the top of the draining sill than the primary drain channel bottom.

In one or more embodiments of the draining sills described herein, the draining sill comprises a base and a cover comprising a separate article attached to a top surface of the base, wherein the bottom of the draining sill is formed by the base, and wherein the cover forms at least a portion of the top of the draining sill, and further wherein the cover comprises an exterior cover edge and an interior cover edge, wherein the interior cover edge is located between the exterior cover edge and the interior edge of the draining sill, and still further wherein the primary drain channel is on the base and the first auxiliary channel is on the cover.

In one or more embodiments of the draining sills described herein that include a second auxiliary channel, the draining sill comprises a base and a cover comprising a separate article attached to a top surface of the base, wherein the bottom of the draining sill is formed by the base, and wherein the cover forms at least a portion of the top of the draining sill, and further wherein the cover comprises an exterior cover edge and an interior cover edge, wherein the interior cover edge is located between the exterior cover edge and the interior edge of the draining sill, and still further wherein the primary drain channel is on the base and both the first auxiliary channel and the second auxiliary channel are on the cover.

In one or more embodiments of the draining sills described herein that include an intermediate auxiliary channel, the draining sill comprises a base and a cover comprising a separate article attached to a top surface of the base, wherein the bottom of the draining sill is formed by the base, and wherein the cover forms at least a portion of the top of the draining sill, and further wherein the cover comprises an exterior cover edge and an interior cover edge, wherein the interior cover edge is located between the exterior cover edge and the interior edge of the draining sill, and still further wherein the primary drain channel on the base, and yet further wherein the first auxiliary channel, the second auxiliary channel, and the intermediate auxiliary channel are on the cover.

In one or more embodiments of the draining sills described herein, the draining sill comprises a base and a cover comprising a separate article attached to a top surface of the base, wherein the bottom of the draining sill is formed by the base, wherein the cover comprises an exterior cover edge and an interior cover edge, wherein the interior cover edge is located between the exterior cover edge and the interior edge of the draining sill, and wherein the primary drain channel and the first auxiliary channel are both formed on the base.

In one or more embodiments of the draining sills described herein that include a base and a cover, the exterior cover edge is located between exterior edge of the draining sill and the interior cover edge.

In one or more embodiments of the draining sills described herein that include a base and a cover, the interior cover edge is located above the primary drain channel.

In one or more embodiments of the draining sills described herein that include a base and a cover, the draining sill comprises one or more collection chambers located below the bottom of the draining sill and configured to collect water passing through the plurality of drain openings.

In a second aspect, one or more embodiments of a window or door frame assembly are described herein, the window or door frame assembly comprising a first side jamb, a second side jamb, a head jamb, a draining sill, and a first panel configured for movement relative to a frame opening formed between the first side jamb, the second side jamb, the head jamb, and the draining sill such that the first panel closes or opens at least a portion of the frame opening. The draining sill in the window or door frame assembly may include: a primary drain channel comprising a primary channel bottom located between the top and a bottom of the draining sill, wherein the primary drain channel extends from a first location proximate a first end of the draining sill to a second location proximate a second end of the draining sill, and wherein the primary drain channel is located between an exterior edge and an interior edge of the draining sill; a plurality of drain openings extending through the draining sill within the primary drain channel, wherein each drain opening of the plurality of drain openings extends through the bottom of the draining sill; and a first auxiliary channel located between the exterior edge of the draining sill and the primary drain channel, wherein the first auxiliary channel terminates at a first auxiliary channel terminus configured to drain fluid in the first auxiliary channel into the primary drain channel, wherein the first auxiliary channel terminus is located between the first location of the primary drain channel and the second location of the primary drain channel, and wherein the first auxiliary channel terminus is located closer to the first end than the second end of the draining sill, and further wherein the first auxiliary channel extends from the first auxiliary channel terminus towards the first end of the draining sill.

In one or more embodiments of the window or door frame assemblies described herein, the first location of the primary drain channel is spaced apart from the first end of the draining sill, and wherein the first location is located between the first auxiliary channel terminus and the first end along the length of the draining sill.

In one or more embodiments of the window or door frame assemblies described herein, the first auxiliary channel terminus is located above the primary drain channel.

In one or more embodiments of the window or door frame assemblies described herein, the first auxiliary channel comprises a depth measured from the top of the draining sill that decreases when moving along the first auxiliary channel from the first auxiliary channel terminus towards the first end of the draining sill.

In one or more embodiments of the window or door frame assemblies described herein, the first auxiliary channel comprises a first auxiliary channel bottom, and the first auxiliary channel bottom is located closer to the top of the draining sill than the primary drain channel bottom.

In one or more embodiments of the window or door frame assemblies described herein, the draining sill further comprises: a second auxiliary channel located between the exterior edge of the draining sill and the primary drain channel, wherein the second auxiliary channel terminates at a second auxiliary channel terminus configured to drain fluid in the second auxiliary channel into the primary drain channel, wherein the second auxiliary channel extends from the second auxiliary channel terminus towards the second end of the draining sill; wherein the first auxiliary channel terminus is located between the first location of the primary drain channel and the second auxiliary channel terminus along the length of the draining sill; and wherein the second auxiliary channel terminus is located between the second location of the primary drain channel and the first auxiliary channel terminus along the length of the draining sill.

In one or more embodiments of the window or door frame assemblies having a draining sill with a second auxiliary channel as described herein, the second location of the primary drain channel is spaced apart from the second end of the draining sill, and wherein the second location is located between the second auxiliary channel terminus and the second end of the draining sill along the length of the draining sill.

In one or more embodiments of the window or door frame assemblies having a draining sill with a second auxiliary channel as described herein, the second auxiliary channel terminus is located above the primary drain channel.

In one or more embodiments of the window or door frame assemblies having a draining sill with a second auxiliary channel as described herein, the second auxiliary channel comprises a depth measured from the top of the draining sill that decreases when moving along the second auxiliary channel from the second auxiliary channel terminus towards the second end of the draining sill.

In one or more embodiments of the window or door frame assemblies having a draining sill with a second auxiliary channel as described herein, the second auxiliary channel comprises a second auxiliary channel bottom, and wherein the second auxiliary channel bottom is located closer to the top of the draining sill than the primary drain channel bottom.

In one or more embodiments of the window or door frame assemblies having a draining sill with a second auxiliary channel as described herein, the frame assembly comprises a second panel configured for movement relative to the frame opening such that the second panel closes or opens at least a portion of the frame opening, wherein the first panel and the second panel comprise a closed configuration in which a free edge of the first panel meets a free edge of the second panel at a junction located within the frame opening between the first and second side jambs, and wherein the draining sill further comprises: an intermediate auxiliary channel located beneath the junction, wherein the intermediate auxiliary channel is located between the exterior edge and the primary drain channel, and wherein the intermediate auxiliary channel comprises an intermediate auxiliary channel terminus configured to drain fluid in the intermediate auxiliary channel into the primary drain channel; wherein the intermediate auxiliary channel terminus is located between the first auxiliary channel terminus and the second auxiliary channel terminus.

In one or more embodiments of the window or door frame assemblies having a draining sill with an intermediate auxiliary channel as described herein, the intermediate auxiliary channel terminus is located above the primary drain channel.

In one or more embodiments of the window or door frame assemblies having a draining sill with an intermediate auxiliary channel as described herein, the intermediate auxiliary channel comprises a depth measured from the top of the draining sill that decreases when moving along the intermediate auxiliary channel away from the intermediate auxiliary channel terminus.

In one or more embodiments of the window or door frame assemblies having a draining sill with an intermediate auxiliary channel as described herein, the intermediate auxiliary channel comprises an intermediate auxiliary channel bottom, and wherein the intermediate auxiliary channel bottom is located closer to the top of the draining sill than the primary drain channel bottom.

In one or more embodiments of the window or door frame assemblies described herein, the draining sill comprises a base and a cover comprising a separate article attached to a top surface of the base, wherein the bottom of the draining sill is formed by the base, and wherein the cover forms at least a portion of the top of the draining sill, and further wherein the cover comprises an exterior cover edge and an interior cover edge, wherein the interior cover edge is located between the exterior cover edge and the interior edge of the draining sill, and still further wherein the primary drain channel is on base and the first auxiliary channel is on the cover.

In one or more embodiments of the window or door frame assemblies described herein that include a draining sill having a base and a cover, the exterior cover edge is located between exterior edge of the draining sill and the interior cover edge.

In one or more embodiments of the window or door frame assemblies described herein that include a draining sill having a base and a cover, the interior cover edge is located above the primary drain channel.

In one or more embodiments of the window or door frame assemblies described herein, the draining sill comprises a base and a cover comprising a separate article attached to a top surface of the base, wherein the bottom of the draining sill is formed by the base, wherein the cover comprises an exterior cover edge and an interior cover edge, wherein the interior cover edge is located between the exterior cover edge and the interior edge of the draining sill, and wherein the primary drain channel and the first auxiliary channel are both formed on the base.

In one or more embodiments of the window or door frame assemblies described herein, the draining sill comprises one or more collection chambers located below the bottom of the draining sill and configured to collect water passing through the plurality of drain openings.

As used herein and in the appended claims, the singular forms "a," "an," and "the" include plural referents unless the context clearly dictates otherwise. Thus, for example, reference to "a" or "the" component may include one or more of the components and equivalents thereof known to those skilled in the art. Further, the term "and/or" means one or all of the listed elements or a combination of any two or more of the listed elements.

It is noted that the term "comprises" and variations thereof do not have a limiting meaning where these terms appear in the accompanying description. Moreover, "a," "an," "the," "at least one," and "one or more" are used interchangeably herein.

Where used herein, the terms "top" and "bottom" are used for reference relative to each other when the draining sills and/or frame assemblies described herein are properly installed in a building opening.

Where used herein, the terms "exterior" and "interior" are used in a relative sense, e.g., an exterior edge and an interior edge of a draining sill or any other component describe edges located on opposite sides of the draining sill or other component. In other words, an exterior edge could be found within the interior of a building or other structure that would conventionally define an interior and an exterior, while an interior edge could be found outside of a building or other structure that would conventionally define an interior and an exterior.

The above summary is not intended to describe each embodiment or every implementation of the draining sills, frame assemblies incorporating the same and methods described herein. Rather, a more complete understanding of the invention will become apparent and appreciated by reference to the following Description of Illustrative Embodiments and claims in view of the accompanying figures of the drawing.

DESCRIPTION OF ILLUSTRATIVE EMBODIMENTS

Figure 1:
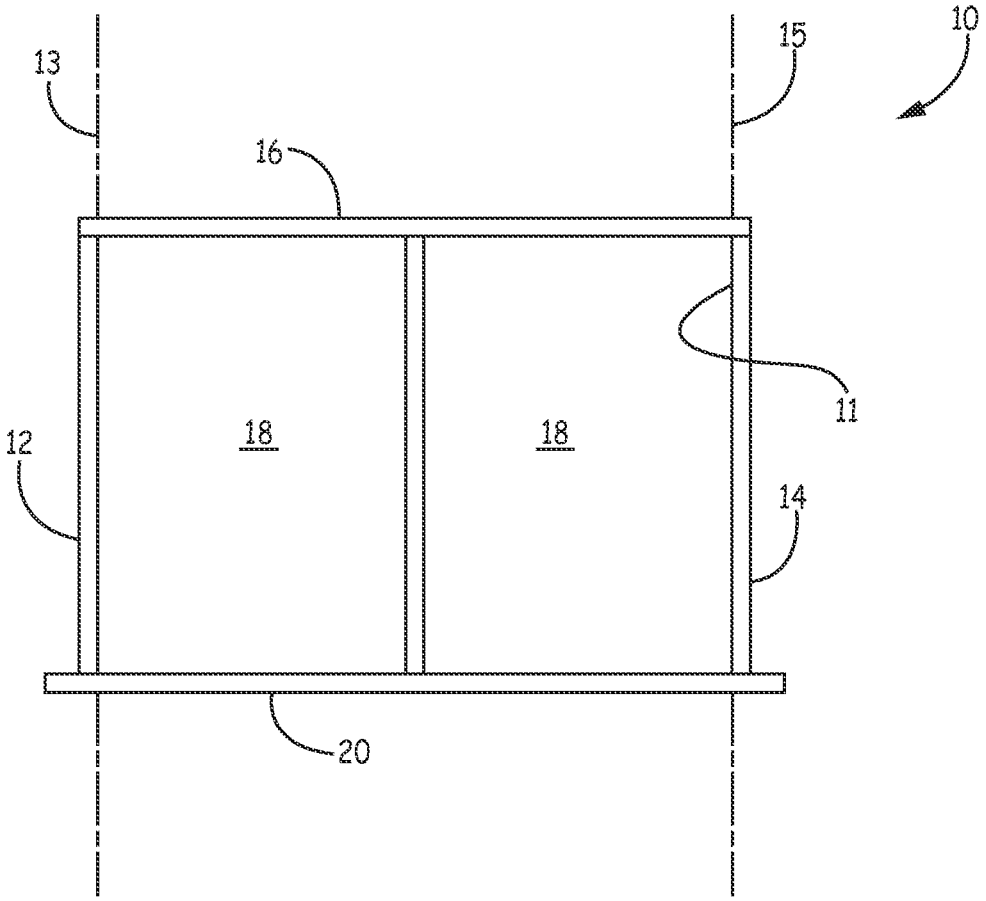
FIG. 1 depicts one illustrative embodiment of a window or door frame assembly incorporating a draining sill as described herein.

In the following description of illustrative embodiments, reference is made to the accompanying figures of the drawing which form a part hereof, and in which are shown, by way of illustration, specific embodiments. It is to be understood that other embodiments may be utilized and structural changes may be made without departing from the scope of the present invention.

One illustrative embodiment of a window or door frame assembly is depicted in FIG. 1. The frame assembly 10 includes a draining sill 20, first side jamb 12, second side jamb 14, head jamb 16 that, when assembled within an opening in a building, form an opening 11. The frame assembly 10 further includes one or more panels 18 mounted within the opening 11, with the one or more panels 18 mounted for movement relative to the opening 11 such that the one or more panels 18 can be moved to close or open at least a portion of the opening 11 to, e.g., allow traffic and/or air to pass through the opening 11.

In one or more embodiments, one or both of the panels 18 may be mounted for rotational movement about an axis aligned with the side jamb to which the panel 18 is connected to move the panel 18 between the open and closed positions. For example, the left panel 18 may be mounted for rotational movement within the opening about axis 13 that is aligned with the first side jamb 12, while the right side panel 18 may be mounted for rotational movement within the opening about an axis 15 that is aligned with the second side jamb 14. Such an arrangement may be found in, e.g., French doors, café windows, casement windows, etc.

In one or more alternative embodiments, one or both of the panels 18 may be mounted for sliding or gliding movement along an axis aligned with the draining sill 20 to move the panel 18 between the open and closed positions relative to the opening 11. In one or more sliding or gliding embodiments, the panel or panels 18 may be top-hung, i.e., the weight of the panel(s) may be supported along a top edge of the panel 18 proximate the head jamb 16. Such an arrangement may be used in connection with, e.g., sliding or gliding doors or windows and the weight of the panels may be supported along the top of the frame assembly.

In one or more alternative embodiments, both of the panels 18 may be mounted for sliding/gliding and rotational movement along an axis aligned with the draining sill 20 to move the panel 18 between the open and closed positions relative to the opening 11 in the manner of a bi-fold or accordion door or window. In such embodiments, the panels 18 may be top-hung, i.e., the weight of the panel(s) may be supported along a top edge of the panel 18 proximate the head jamb 16.

Although the illustrative embodiment of frame assembly 10 includes two panels 18, both of which are mounted for movement relative to the opening 11 formed by the frame assembly 10, in one or more alternative embodiments, the opening defined by a frame assembly as described herein may be occupied by only a single panel. In one or more other alternative embodiments, the opening formed by the frame assembly as described herein may be occupied by two or more panels, only one of which is mounted for movement to open or close the opening formed in the frame assembly. In one or more additional alternative embodiments, the opening formed in a frame assembly as described herein may be occupied by three or more panels, at least one of which is mounted for movement to open or close the opening formed in the frame assembly. In one or more additional alternative embodiments, the opening formed in a frame assembly as described herein may be occupied by three or more panels, at least one of which is mounted for movement to open or close the opening formed in the frame assembly and at least one of which is not mounted for movement to open or close the frame opening.

Figure 2:
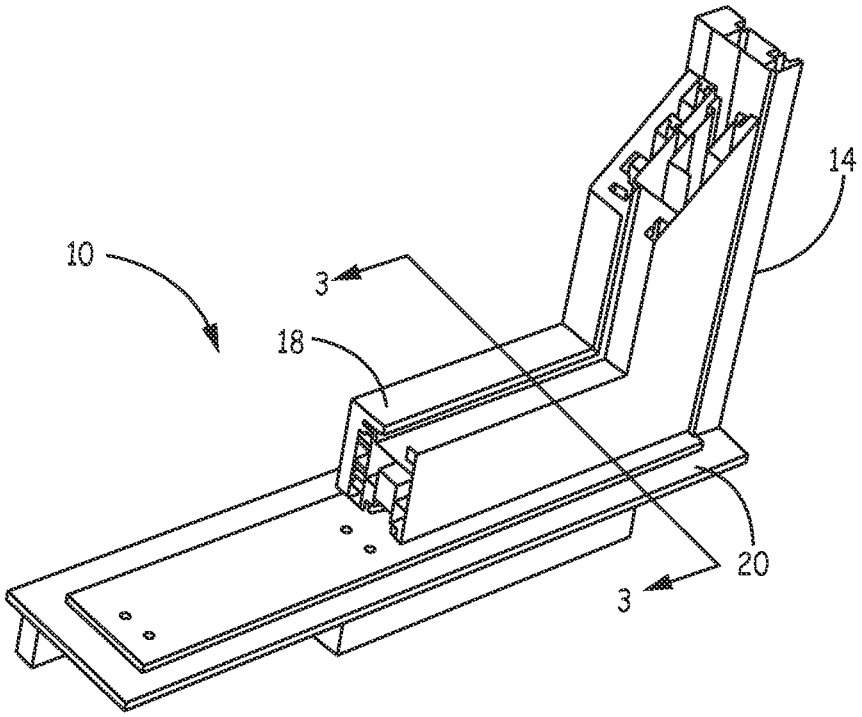
FIG. 2 is a perspective view of a portion of the frame assembly of FIG. 1, the view including the junction between a side jamb and the draining sill as described herein.

A perspective view of a portion of the illustrative embodiment of frame assembly 10 is depicted in FIG. 2. More particularly, the view seen in FIG. 2 is of the junction between the draining sill 20 and the side jamb 12. The view seen in FIG. 2 also includes a portion of the panel 18. As seen in FIG. 2, the draining sill 20 includes a primary drain channel 30 having drain openings 36 formed therethrough.

Figure 3:
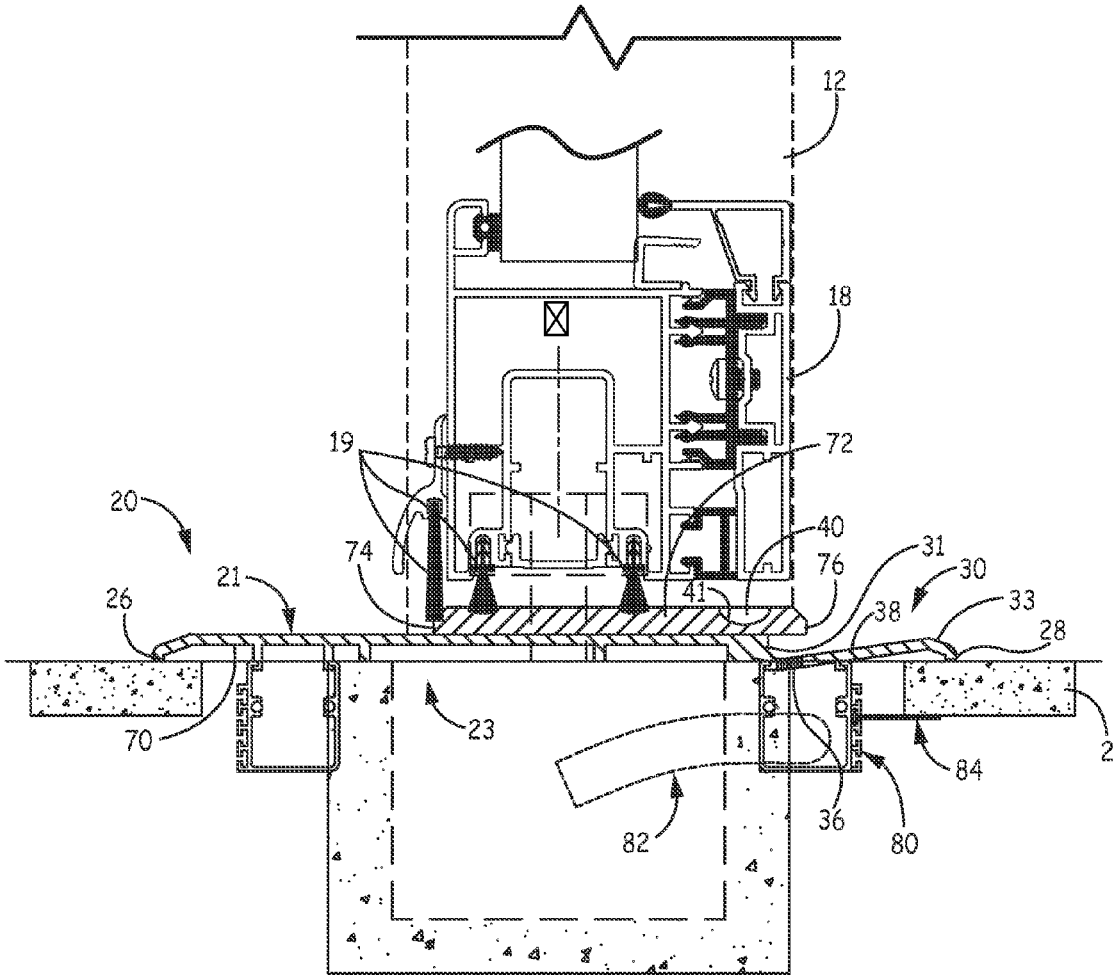
FIG. 3 is a cross-sectional view of the assembly of FIG. 2 taken along line 3-3 in FIG. 2.
Figure 4:
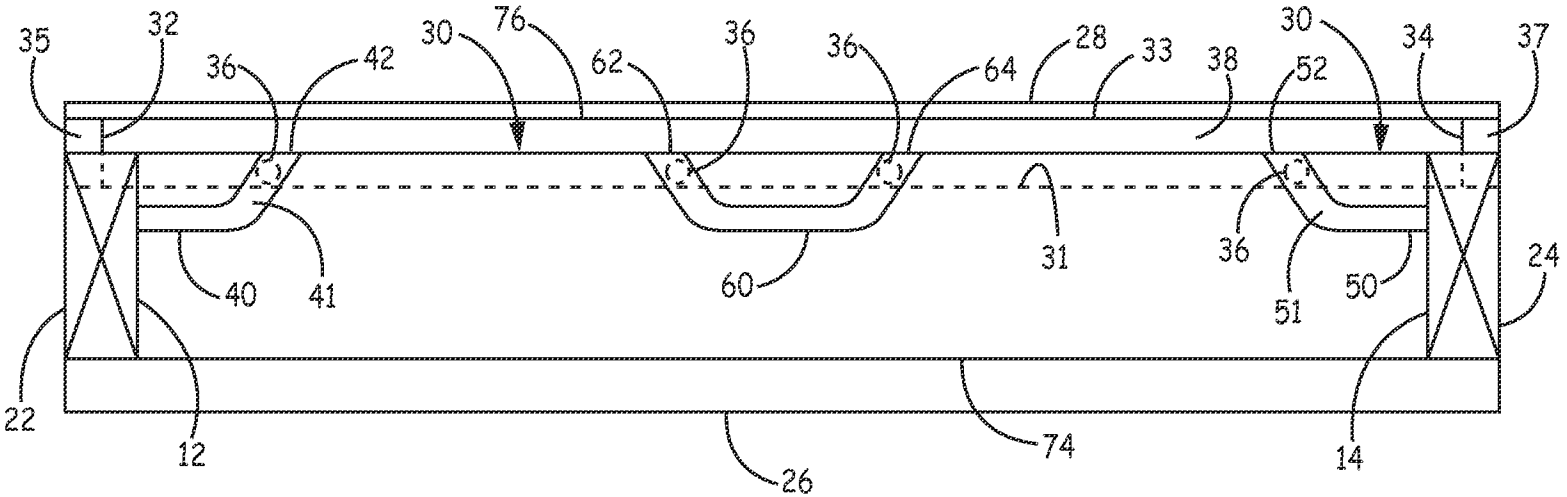
FIG. 4 is a top plan view of one illustrative embodiment of a draining sill as described herein.

FIG. 3 is a cross-sectional view taken along line 3-3 in FIG. 2, while FIG. 4 is a top plan view of the draining sill 20 removed from the frame assembly 10 so that the features on the draining sill 20 can be seen in FIG. 4. As seen in, e.g., FIG. 3, a window or door panel 18 located above the draining sill 20 may include one or more weatherstrip features 15 that act on the top 21 of the draining sill 20 in an attempt to limit the passage of water between the panel 18 and the draining sill 20. In one or more embodiments, the weatherstrip features 15 may all be located on an exterior side of any auxiliary channels as well as the primary drain channel in the draining sill 20.

Yet another feature depicted in the cross-sectional view of FIG. 3 is a collection chamber 80 that may be positioned below the bottom 23 of the draining sill 20. The collection chamber 80 is configured to collect water passing through the drain openings 36 in the primary drain channel 30. In one or more embodiments of the draining sills described herein, a collection chamber used in conjunction with the draining sill may include a fin 84 that may be positioned below flooring 2, where the draining sill 20 is mounted on the upper surface of flooring 2. The fin 84 may, in one or more embodiments, assist in stabilizing the collection chamber 80 and/or sealing an opening in the flooring 2.

The draining sills as described herein may include a single collection chamber that extends and is positioned to collect water passing through all of the drain openings located in the primary drain channel or a plurality of collection chambers that, together, collect water passing through all of the drain openings located in the primary drain channel. In one or more embodiments, the collection chamber 80 may itself be drained by a drain tube 82 positioned to receive water from the collection chamber and deliver it to another location.

One potential advantage of a collection chamber and drain tube arrangement as seen in, e.g., FIG. 3, is that the potential height of the water column defined on its upper end by the drain openings 36 and on its lower end by the end of a drain tube 82 can be adjusted to provide any desired water column height. Furthermore, the drain tube 82 may drain water collected in the collection chamber 80 to a location outside of a building in which draining sill 20 is used, or may drain water collected therein to a location inside the building such as, e.g., a floor drain, utility tub, sink, etc.

The draining sill 20 includes a top 21 and a bottom 23 as seen in, e.g., FIG. 4. The top 21 faces upward away from a floor or other surface on which the draining sill 20 is located, while the bottom 23 faces the floor or other surface on which the draining sill 20 is located. The draining sill 20 includes a first end 22 and a second end 24, along with an exterior edge 26 and an interior edge 28.

Also depicted in the top plan view of FIG. 4 are the locations of side jambs 12 and 14 on each end of the draining sill 20. In one or more embodiments, the draining sill 20 may be designed to extend under the side jambs as seen in FIG. I. In one or more alternative embodiments, however, the draining sills as described herein may be designed to butt up against the side jambs, in other words, the draining sill may or may not extend underneath one or both of the side jambs.

The illustrative embodiment of draining sill 20 includes a primary drain channel 30 formed in or on the top 21 of the draining sill 20 and an auxiliary channel 40 formed in or on the top 21 of the draining sill 20. The depicted illustrative embodiment of draining sill 20 also includes an optional auxiliary channel 50 formed in or on the top 21 of the draining sill 20 at the opposite end 24 of the draining sill 20 from auxiliary channel 40. Furthermore, the depicted illustrative embodiment of draining sill 20 includes optional intermediate auxiliary channel 60 located at an intermediate location between the first and second ends 22 and 24 of the draining sill 20. As described herein, all of the auxiliary channels are, in one or more embodiments, configured to drain water collected therein into the primary drain channel 30.

The primary drain channel 30 extends from a first location 32 to a second location 34 along the length of the draining sill 20 between the first end 22 and the second end 24. The primary drain channel 30 is located between the exterior edge 26 and the interior edge 28 of the draining sill 20. In one or more embodiments, the primary drain channel 30 may preferably be located on an interior side of any door or window panel 18 located above the draining sill 20 such that the primary drain channel 30 (and any drain openings 36 located therein) are located between the panel 18 and the interior edge 28 of the draining sill 20.

The primary drain channel 30 has a primary channel bottom 38 that, in the depicted illustrative embodiment, extends from an inner edge 31 to an outer edge 33, where the outer edge 33 of the primary drain channel 30 is located closer to the interior edge 28 of the draining sill 20 than the inner edge 31 of the primary drain channel 30. In particular, the primary channel bottom 38 as depicted in the illustrative embodiment of draining sill 20 is sloped or angled such that water on the bottom 38 of the primary drain channel 30 is directed towards the inner edge 31 of the primary drain channel 30. The shape of the primary drain channel 30 is selected such that water located therein is limited or prevented from passing out of the primary drain channel 30 towards the interior edge 28 of the draining sill 20. The depicted embodiment of primary drain channel 30 as seen in connection with this illustrative embodiment of draining sill 20 is only one example of the shape of a primary drain channel that may be used in the draining sills as described herein.

Another feature of the primary drain channels that may be used in draining sills as described herein are the locations at which the primary drain channel 30 terminates on each of its two ends. In particular, primary drain channel 30 terminates on one end at a first location 32 that is proximate the first end 22 of the draining sill 20, while the primary drain channel 30 terminates on its opposite end at a second location 34 that is proximate the second end 24 of the draining sill 20. As used herein, the term "proximate" means that, e.g., the first location 32 of the primary drain channel 30 may be at the first end 22 of the draining sill 20 or may terminate short of the first end 22, but within a relatively short distance (for example, 4 inches or less, 2 inches or less, 1 inch or less, ½ inch or less, etc.). The same relationship can be described with respect to the second location 34 of the primary drain channel 30 and the second end 24 of the draining sill 20.

In one or more embodiments, the first location 32 at which the primary drain channel 30 terminates is spaced apart from the first end 22 of the draining sill 20 such that the primary drain channel 30 does not extend completely to the end 22 of the draining sill 20. In the illustrative embodiment of primary drain channel 30 as depicted in, e.g., FIGS. 3 and 4, the draining sill 20 includes a first end plug 35 located between the first location 32 and the first end 22 of the draining sill 20 and a second end plug 37 located between the second location 34 and the second end 24 of the draining sill 20 (the end plug 37 is not included in the cross-sectional view of FIG. 3 for clarity). The end plugs 35 and 37 provide the spacing between the first location 32 and the first end 22 of the draining sill 20 and the second location 34 and the second and 24 of the draining sill 20 in the embodiment depicted in, e.g., FIG. 4.

The illustrative embodiment of draining sill 20 also includes drain openings 36 located in the primary drain channel 30. The drain openings 36 are formed through the draining sill 20 such that the drain openings 36 extend through the bottom 23 of the draining sill 20. The drain openings 36 are, in one or more embodiments, preferably found at the lowest portion of the primary drain channel 30 such that water collected in the primary drain channel 30 can pass out of the primary drain channel 30 through the drain openings 36. The size, shape, and/or location of the drain openings can vary between different draining sills or even within the same draining sill (i.e., the drain openings having different sizes and/or shapes can be used in the same primary drain channel). In the illustrative example of draining sill 20, the drain openings 36 may be preferentially located proximate a terminus of one or more of the auxiliary channels as described herein.

The illustrative embodiment of draining sill 20 as depicted in FIGS. 2-4 includes an auxiliary channel 40 that extends from the junction between the side jamb 12 on the first end 22 of the draining sill 20 towards the second end 24 of the draining sill 20. In one or more embodiments, the auxiliary channel 40 may extend all the way to the first end 22 of the draining sill 20 where the auxiliary channel 40 may or may not be closed by a plug or other structure. In the depicted illustrative embodiment of auxiliary channel 40, however, the auxiliary channel 40 extends at least from the junction between side jamb 12 and the top 21 of the draining sill 20 such that water moving across the top surface 21 of the draining sill 20 along the side jamb 12 must pass into the auxiliary channel 40 before reaching the primary drain channel 30. In one or more embodiments, the auxiliary channel 40 can be described as extending from its auxiliary channel terminus 42 towards the first end 22 of the draining sill 20.

The illustrative embodiment of auxiliary channel 40 formed in or on the top 21 of the draining sill 20 is located between the exterior edge 26 of the draining sill 20 and the primary drain channel 30. Further, the auxiliary channel 40 terminates at an auxiliary channel terminus 42 that is configured to drain fluid in the auxiliary channel 40 into the primary drain channel 30. In one or more embodiments, the auxiliary channel terminus 42 can be described as being located between the first location 32 of the primary drain channel 30 and the second location 34 of the primary drain channel 30 and, further, that the auxiliary channel terminus 42 is located closer to the first end 22 than the second end 24 of the draining sill 20. In other words, the auxiliary channel 40 does not extend across the opening formed between side jambs 12 and 14 but, rather, occupies only a portion of the length of the draining sill 20. In one or more embodiments, the length of the auxiliary channel 40 as measured along the length of the draining sill 20 from the first end 22 to the second end 24 may be limited such that the length of the auxiliary channel 40 is equal to or less than 25% of the length of the draining sill 20, or in one or more alternative embodiments, to a length of 10% or less of the length of the draining sill 20.

In one or more embodiments of the draining sills described herein, the auxiliary channel 40 may include an auxiliary channel terminus 42 that is located above the primary drain channel 30. The auxiliary channel terminus 42 may, in one or more embodiments, be located directly above a drain opening 36 formed in the primary drain channel 30. Such an arrangement may, for example, promote drainage of both the auxiliary channel 40 and the primary drain channel 30. This arrangement is seen in connection with the illustrative embodiment of draining sill 20.

In one or more embodiments of the draining sills described herein, an auxiliary channel such as auxiliary channel 40 may be described as having a depth measured from the top 21 towards the bottom 23 of the draining sill 20 that decreases when moving along the auxiliary channel 40 from the auxiliary channel terminus 42 towards the first end 22 of the draining sill 20. The change in depth within the auxiliary channel 40 assists in moving water collected in the auxiliary channel 40 towards the auxiliary channel terminus 42 where it drains into the primary drain channel 30 as described herein.

In one or more embodiments of the draining sills described herein, an auxiliary channel such as auxiliary channel 40 may be described as having an auxiliary channel bottom 41. Furthermore, the auxiliary channel bottom 41 may be described as being located closer to the top 21 of the draining sill 20 than the primary drain channel bottom 38 (see, e.g., FIG. 3).

The illustrative embodiment of draining sill 20 as depicted and described herein includes an optional second auxiliary channel 50 formed in or on the top 21 of the draining sill 20. In one or more embodiments, the second auxiliary channel 50 may be similar to the auxiliary channel 40. For example, the second auxiliary channel 50 may be described as being located between the exterior edge 26 of the draining sill 20 and the primary drain channel 30. Further, the second auxiliary channel 50 may terminate at a second auxiliary channel terminus 52 that is configured to drain fluid in the second auxiliary channel into the primary drain channel 30. In one or more embodiments, the second auxiliary channel 50 may be described as extending from the second auxiliary channel terminus 52 towards the second and 24 of the draining sill 20.

In one or more embodiments, the second auxiliary channel terminus 52 may be described as being located between the second location 34 of the primary drain channel 30 and the auxiliary channel terminus 42 of the auxiliary channel 40 located on the opposite end of the draining sill 20. Furthermore, in a draining sill 20 including both auxiliary channel 40 and auxiliary channel 50, the auxiliary channel terminus 42 may be described as being located between the first location 32 of the primary drain channel 30 and the second auxiliary channel terminus 52. In other words, the second auxiliary channel 50 does not extend across the opening formed between side jambs 12 and 14 but, rather, occupies only a portion of the length of the draining sill 20. In one or more embodiments, the length of the second auxiliary channel 50 as measured along the length of the draining sill 20 from the first end 22 to the second end 24 may be limited such that the length of the second auxiliary channel 50 is equal to or less than 25% of the length of the draining sill 20, or in one or more alternative embodiments, to a length of 10% or less of the length of the draining sill 20.

In one or more embodiments of the draining sills described herein, the second auxiliary channel 50 may include an auxiliary channel terminus 52 that is located above the primary drain channel 30. The second auxiliary channel terminus 52 may, in one or more embodiments, be located directly above a drain opening 36 formed in the primary drain channel 30. Such an arrangement may, for example, promote drainage of both the second auxiliary channel 50 and the primary drain channel 30. This arrangement is seen in connection with the illustrative embodiment of draining sill 20.

In one or more embodiments of the draining sills described herein, an auxiliary channel such as second auxiliary channel 50 may be described as having a depth measured from the top 21 of the draining sill 20 towards the bottom 23 that decreases when moving along the second auxiliary channel 50 from the second auxiliary channel terminus 52 towards the second end 24 of the draining sill 20. The change in depth within the second auxiliary channel 50 assists in moving water collected in the second auxiliary channel 50 towards the auxiliary channel terminus 52 where it drains into the primary drain channel 30 as described herein.

In one or more embodiments of the draining sills described herein, an auxiliary channel such as second auxiliary channel 50 may be described as having an auxiliary channel bottom 51. Furthermore, the second auxiliary channel bottom 51 may be described as being located closer to the top 21 of the draining sill 20 than the primary drain channel bottom 38.

Although the auxiliary channel 40 and second auxiliary channel 50 are depicted as having similar sizes and shapes, in one or more alternative embodiments, the auxiliary channels found on opposite ends of the draining sills described herein may or may not have similar shapes. In other words, the similarity in sizes and/or shapes between auxiliary channels 40 and 50 is not required in draining sills as described herein. Furthermore, although each of the auxiliary channels 40 and 50 include a length along which the auxiliary channel runs parallel to the length of the draining sill 20 as measured between its first and second ends 22 and 24, such an arrangement is not required.

In addition to the auxiliary channels 40 and 50 located at opposite ends of the illustrative embodiment of draining sill 20, an intermediate auxiliary channel 60 is also provided in this illustrative embodiment. When provided, an intermediate auxiliary channel 60 may be positioned beneath, e.g., a location at which two window or door panels meet above the draining sill 20 to provide additional protection against water passage over the top 21 of the draining sill 20 at that junction.

The illustrative embodiment of intermediate auxiliary channel 60 is, like the auxiliary channels 40 and 50, formed in or on the top 21 of the draining sill 20 and is located between the exterior edge 26 of the draining sill 20 and the primary drain channel 30. In one or more embodiments, the intermediate auxiliary channel 60 may extend from a first intermediate auxiliary channel terminus 62 to a second intermediate auxiliary channel terminus 64. Such an arrangement is not, however, necessarily required and an intermediate auxiliary channel used in a draining sill as described herein may have only one terminus.

In the illustrative embodiment as depicted in FIG. 4, the intermediate auxiliary channel 60 is configured to drain water collected therein into the primary drain channel 30 through both the first intermediate auxiliary channel terminus 62 and the second intermediate auxiliary channel terminus 64. In one or more embodiments, the first intermediate auxiliary channel terminus 62 can be described as located between the auxiliary channel terminus 42 of auxiliary channel 40 and the second intermediate auxiliary channel terminus 64. In one or more embodiments, the second intermediate auxiliary channel terminus 64 can be described as located between the second auxiliary channel terminus 52 and the first intermediate auxiliary channel terminus 62. In one or more embodiments, the length of the intermediate auxiliary channel 60 as measured along the length of the draining sill 20 from the first end 22 to the second end 24 may be limited such that the length of the intermediate auxiliary channel 60 is equal to or less than 25% of the length of the draining sill 20, or in one or more alternative embodiments, to a length of 10% or less of the length of the draining sill 20.

In one or more embodiments, the first intermediate auxiliary channel terminus 62 and the second intermediate artillery channel terminus 64 may both be located above the primary drain channel 30. Each of the first intermediate auxiliary channel terminus 62 and the second intermediate artillery channel terminus 64 may, in one or more embodiments, be located directly above a drain opening 36 formed in the primary drain channel 30. Such an arrangement may, for example, promote drainage of both the intermediate auxiliary channel 60 and the primary drain channel 30. This arrangement is seen in connection with the illustrative embodiment of draining sill 20.

Further, in one or more embodiments, a first portion of the intermediate auxiliary channel 60 may have a depth measured from the top 21 of the draining sill 20 that decreases when moving along the intermediate auxiliary channel 60 away from the first intermediate auxiliary channel terminus 62 such that water located in that portion of the intermediate auxiliary channel 60 would flow under the force of gravity towards the first intermediate auxiliary channel terminus 62. In one or more embodiments, a second portion of the intermediate auxiliary channel 60 may have a depth measured from the top 21 of the draining sill 20 that also decreases when moving along the intermediate auxiliary channel 60 away from the second intermediate auxiliary channel terminus 64 such that water collected in that portion of the intermediate auxiliary channel 60 would flow under the force of gravity towards the second intermediate auxiliary channel terminus 64. In an embodiment such as this, the first and second portions of the intermediate auxiliary channel 60 may have equal lengths, but such an arrangement is not required.

In one or more embodiments of draining sills as described herein that include an intermediate auxiliary channel such as intermediate auxiliary channel 60, the intermediate auxiliary channel 60 may be described as having an intermediate auxiliary channel bottom 61 that is located closer to the top 21 of the draining sill 20 than the primary drain channel bottom 38 of the primary drain channel 30.

Figure 5:
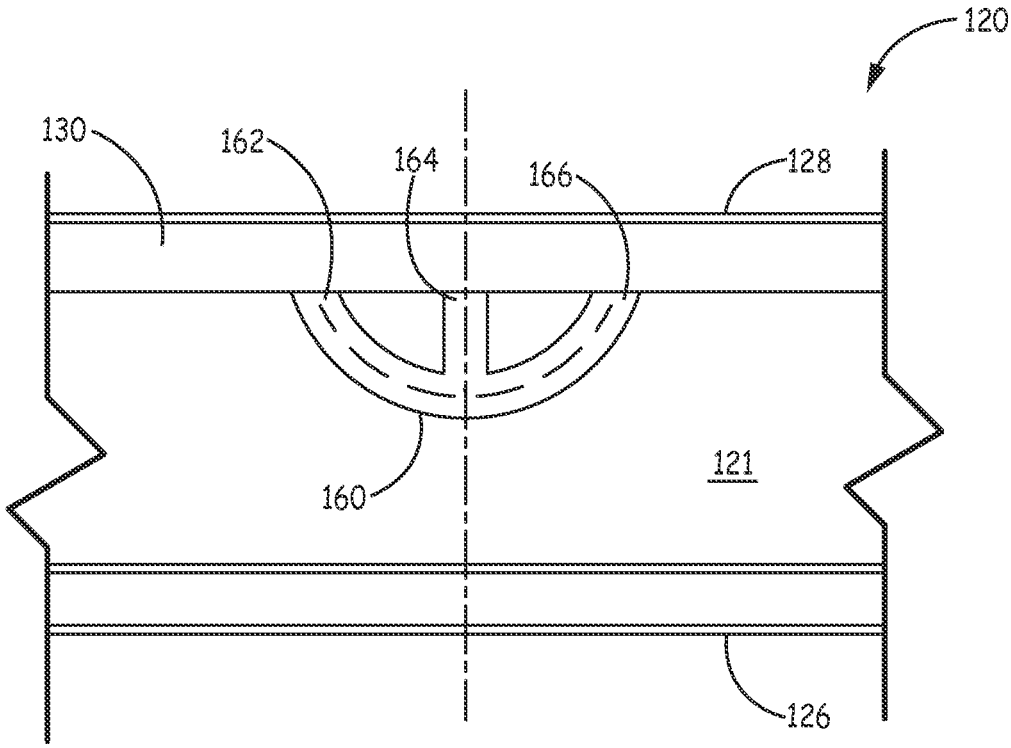
FIG. 5 is a top plan view of one alternative illustrative embodiment of an intermediate auxiliary channel in a draining sill as described herein.

The illustrative embodiment of intermediate auxiliary channel 60 as depicted in connection with the illustrative embodiment of draining sill 20 is only one example of the multitude of shapes and configurations that could be used for intermediate auxiliary channels provided in draining sills as described herein. Another potential alternative intermediate auxiliary channel 160 is depicted in FIG. 5 in connection with a portion of a draining sill 120 that includes a primary drain channel 130, and exterior edge 126 and an interior edge 128. The intermediate auxiliary channel 160 is formed in or on the top 121 of the draining sill 120. Where intermediate auxiliary channel 60 includes first intermediate auxiliary channel terminus 62 and second intermediate auxiliary channel terminus 64, the alternative embodiment of intermediate auxiliary channel 160 includes a first intermediate auxiliary channel terminus 162, second intermediate auxiliary channel terminus 164, and a third intermediate auxiliary channel terminus 166.

The intermediate auxiliary channel 160 may, in one or more embodiments, include a first portion in which the channel 160 may have a depth measured from the top 121 of the draining sill 120 that decreases when moving along the intermediate auxiliary channel 160 away from the first intermediate auxiliary channel terminus 162 such that water located in that portion of the intermediate auxiliary channel 160 would flow under the force of gravity towards the first intermediate auxiliary channel terminus 162. In one or more embodiments, a second portion of the intermediate auxiliary channel 160 may have a depth measured from the top 121 of the draining sill 120 that also decreases when moving along the intermediate auxiliary channel 160 away from the second intermediate auxiliary channel terminus 164 such that water collected in that portion of the intermediate auxiliary channel 160 would flow under the force of gravity towards the second intermediate auxiliary channel terminus 164. Similarly, the intermediate auxiliary channel 160 may have a third portion in which the depth of the channel 160 as measured from the top 121 of the draining sill 120 also decreases when moving along the intermediate auxiliary channel 160 away from the third intermediate auxiliary channel terminus 166 such that water collected in the third portion of the intermediate auxiliary channel 160 would flow under the force of gravity towards the third intermediate auxiliary channel terminus 166.

Figure 6:
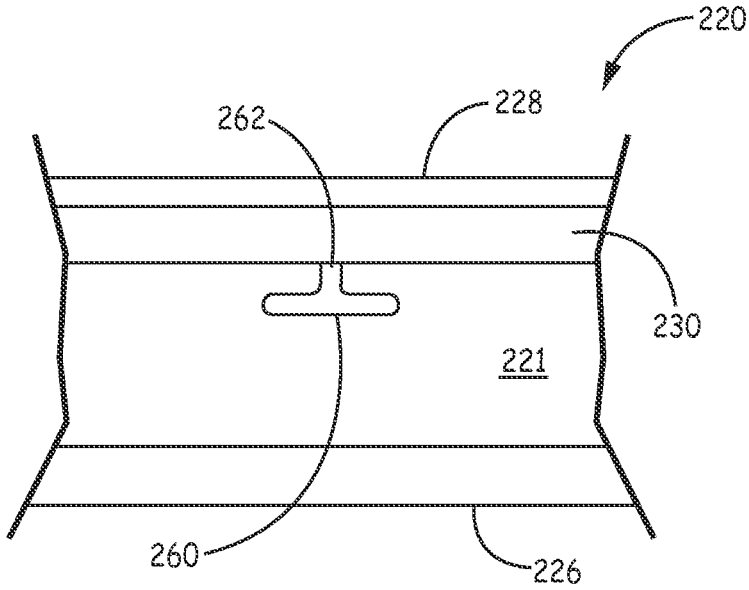
FIG. 6 is a top plan view of another alternative illustrative embodiment of an intermediate auxiliary channel in a draining sill as described herein.

Another potential alternative intermediate auxiliary channel 260 is depicted in FIG. 6 in connection with a portion of a draining sill 220 that includes a primary drain channel 230, an exterior edge 226 and an interior edge 228. The intermediate auxiliary channel 260 is formed in or on the top 221 of the draining sill 220. Where intermediate auxiliary channel 60 includes first intermediate auxiliary channel terminus 62 and second intermediate auxiliary channel terminus 64, alternative embodiment of intermediate auxiliary channel 260 includes only one intermediate auxiliary channel terminus 262.

The intermediate auxiliary channel 260 may, in one or more embodiments, have a depth measured from the top 221 of the draining sill 220 that decreases when moving along the intermediate auxiliary channel 260 away from the intermediate auxiliary channel terminus 262 such that water located in the intermediate auxiliary channel 260 would flow under the force of gravity towards the first intermediate auxiliary channel terminus 262.

The illustrative embodiment of draining sill 20 as seen in the cross-sectional view of, e.g., FIG. 3 may be produced by combining two or more components that are joined or attached together by any suitable technique or combination of techniques such as, e.g., mechanical fasteners, welding, adhesives, etc. In particular, referring to FIG. 3, the draining sill 20 may be constructed from a base 70 and a cover 72 attached to the base 70. When the cover is attached to the base 70, the top 21 of the draining sill is, in one or more embodiments, formed in part by the base 70 and, in part by the cover 72 attached to the base 70.

The cover 72 may include, in one or more embodiments, an exterior cover edge 74 and an interior cover edge 76. The interior cover edge 76 is located between the exterior cover edge 74 and the interior edge 28 of the draining sill 20. In one or more embodiments, the auxiliary channel 40, optional auxiliary channel 50, and optional intermediate auxiliary channel 60 may be formed in or on the cover 72 (see, e.g., the top plan view of FIG. 4). Further, the primary drain channel 30 in such an embodiment may be formed in or on the base 70. In one or more embodiments, the exterior cover edge 74 may be described as being located between exterior edge 26 of the draining sill 20 and the interior cover edge 76.

In one or more embodiments, the interior cover edge 76 may be located above the primary drain channel 30. Such an arrangement may facilitate positioning of any auxiliary channel terminus above the primary drain channel 30 but is not, however, required. In one or more embodiments, the interior cover edge 76 of the cover 72 may be positioned such that the drain openings 36 in the primary drain channel 30 are hidden from view when the draining sill is observed from above the top 21. The hidden nature of the drain openings 36 and the inner edge 31 of the primary drain channel 30 is illustrated by the positions of those features which are depicted in broken lines underneath cover 72 in FIG. 4.

Figure 7A:
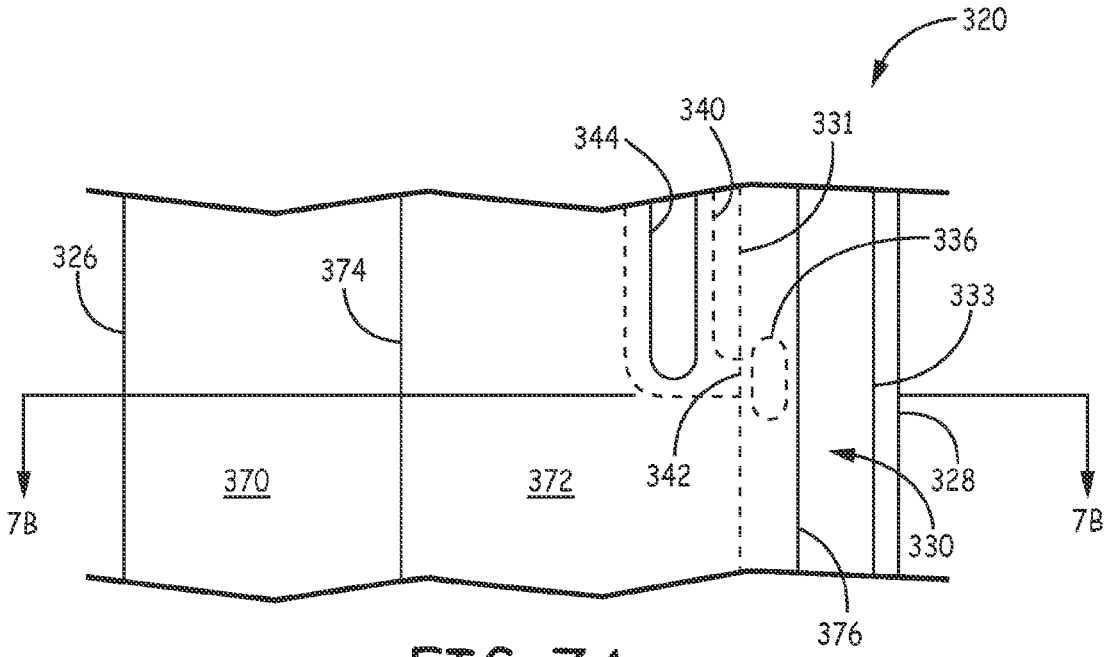
FIG. 7A is a top plan view of a portion of another illustrative embodiment of a draining sill as described herein.
Figure 7C:
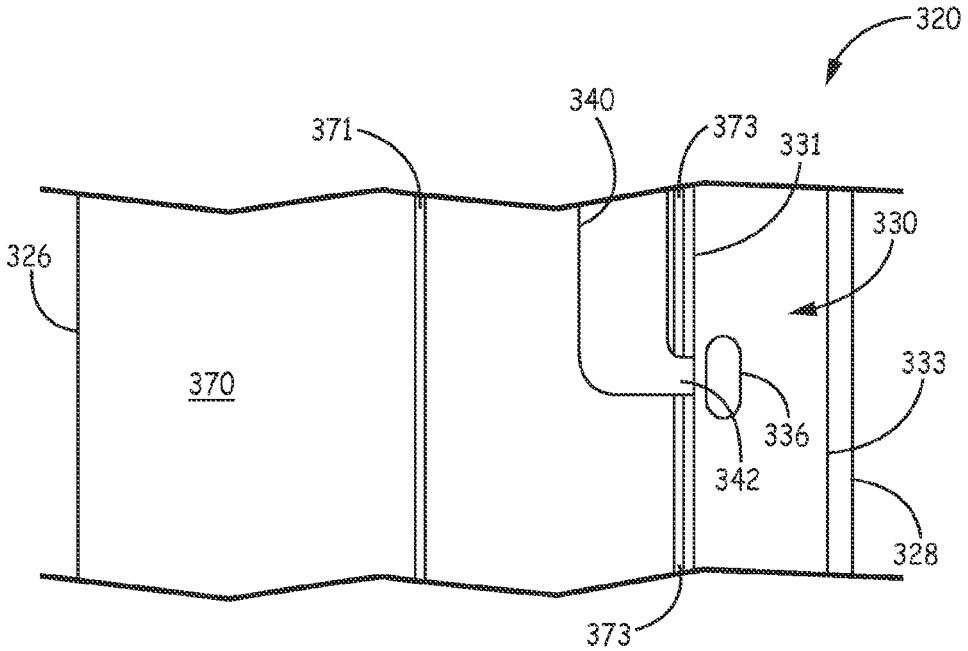
FIG. 7C is a top plan view of the draining sill depicted in FIGS. 7A and 7B, with the cover 372 removed from the base 370 of the draining sill 320.
Figure 7B:
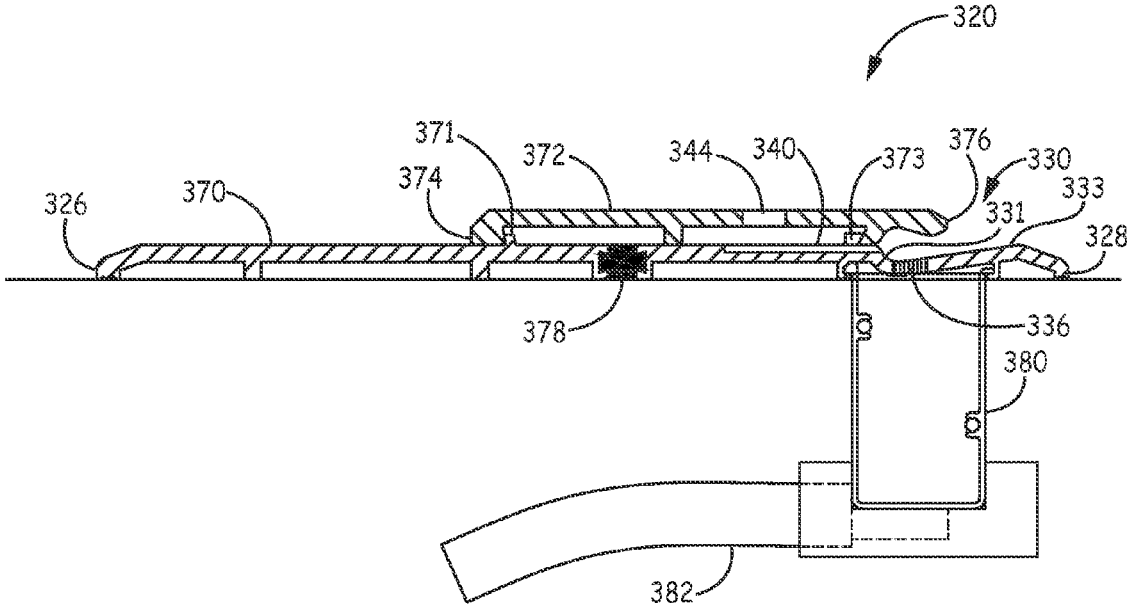
FIG. 7B is a cross-sectional view of the draining sill depicted in FIG. 7A taken along line 7B-7B in FIG. 7A.

Another alternative illustrative embodiment of a draining sill 320 is depicted in FIGS. 7A-7C. Referring to, e.g., FIG. 7A, the draining sill 320 includes a base 370 and a cover 372 attached to the base 370. The cover 372 includes an exterior edge 374 and an interior edge 376, where the exterior edge 374 is located between exterior edge 326 of the draining sill 320 and the interior edge 376 of the cover 372. Further, the interior edge 376 of the cover 372 is located between the exterior edge 374 of the cover 372 and the interior edge 328 of the draining sill 320.

The draining sill 320 is depicted in FIG. 7C with the cover 372 removed from the base 370. The cover 372 of draining sill 320 may, in one or more embodiments, be attached to the base 370 along rails 371 and 373 on base 370 which cooperate with features found on the underside of cover 372. In one or more embodiments, the rails 371 and 373 along with the features found on the underside of cover 372 may be attached to each other using a friction or snap fit.

The base 370 of illustrative embodiment of draining sill 320 defines a primary drain channel 330 bounded by an inner edge 331 and an outer edge 333. The draining sill 320 also includes one or more drain openings 336 formed in the primary drain channel 330 which open into a collection chamber 380. The collection chamber 380 is, itself, drained by a drain tube 382 in a manner similar to that described above in connection with draining sill 20 as depicted in FIG. 3.

One difference between the illustrative embodiment of draining sill 320 and, e.g., the illustrative embodiment of draining sill 20 is that one or more of the auxiliary channels provided in the draining sill 320 may be formed in or on the base 370, with water reaching those auxiliary channels through openings formed through the cover 372. One illustrative embodiment of such an arrangement is depicted in FIGS. 7A-7C, where cover 372 includes an auxiliary channel opening 344 formed through cover 372 such that water can pass through auxiliary channel opening 344 to reach auxiliary channel 340 formed in or on the base 370. The auxiliary channel 340 includes an auxiliary channel terminus 342 through which water in the auxiliary channel 340 enters the primary drain channel 330. The auxiliary channel 340 and its auxiliary channel terminus 342 along with inner edge 331 of primary drain channel 330 and drain opening 336 are all depicted in broken lines in FIG. 7A to show their respective locations relative to the features found in cover 372.

Where, for example, a rail 373 is located in the base 370, the rail 373 may be interrupted by auxiliary channel 340 as seen in, e.g., FIG. 7C. Furthermore, the drain opening 336 may be located underneath a portion of the cover 372 such that the inner edge 376 of cover 372 is located between the drain opening 336 and the outer edge 333 of the primary drain channel 330.

In still one or more alternative embodiments, the channel 340 provided in the base 370 may not be recessed into the surface of the base 370 as depicted in, e.g., FIG. 7B. Rather, the boundaries of the auxiliary channel may be set by one or more ribs that extend upward from the base 370 towards the underside of cover 372. Any such ribs may, in one or more embodiments, follow the outline of auxiliary channel 340, but such an arrangement is not required. In embodiments of auxiliary channels that are formed by one or more raised ribs on base 370, the auxiliary channel terminus may be defined by one or more openings or interruptions in the rib 373 such that water can pass through that opening or interruption into primary drain channel 330.

In one or more alternative embodiments, ribs formed on the base 370 to define an auxiliary channel may be defined by a pair of ribs that extend between, e.g., ribs 371 and 373 to limit the length of an auxiliary channel formed by ribs on the base 370 within the limits described herein with respect to other auxiliary channels. For example, the length of an auxiliary channel formed by such ribs as measured along the length of the draining sill 320 from its first end to its second end may be limited such that the length of the auxiliary channel is equal to or less than 25% of the length of the draining sill 320, or in one or more alternative embodiments, to a length of 10% or less of the length of the draining sill 320.

Another difference between the embodiment of draining sill 320 and draining sill 20 is that the vertical height of the collection chamber 380 is greater than the vertical height of the collection chamber 80 as seen in connection with draining sill 20. As discussed above, such an arrangement can be used to adjust the column height for water collected by the draining sills as described herein.

Another optional feature depicted in connection with the draining sill 320 is the thermal break 378 which may be provided in the base 370 to limit the transfer of thermal energy through the base 370 between the exterior edge 326 and the interior edge 328 of the draining sill 320. The thermal break 378 may preferably be constructed of materials that have a reduced thermal transfer capacity as compared to the materials used in the remainder of the base 370 of the draining sill 320. Although not depicted, the cover 372 may, in one or more embodiments, also include a thermal break.

Figure 8:
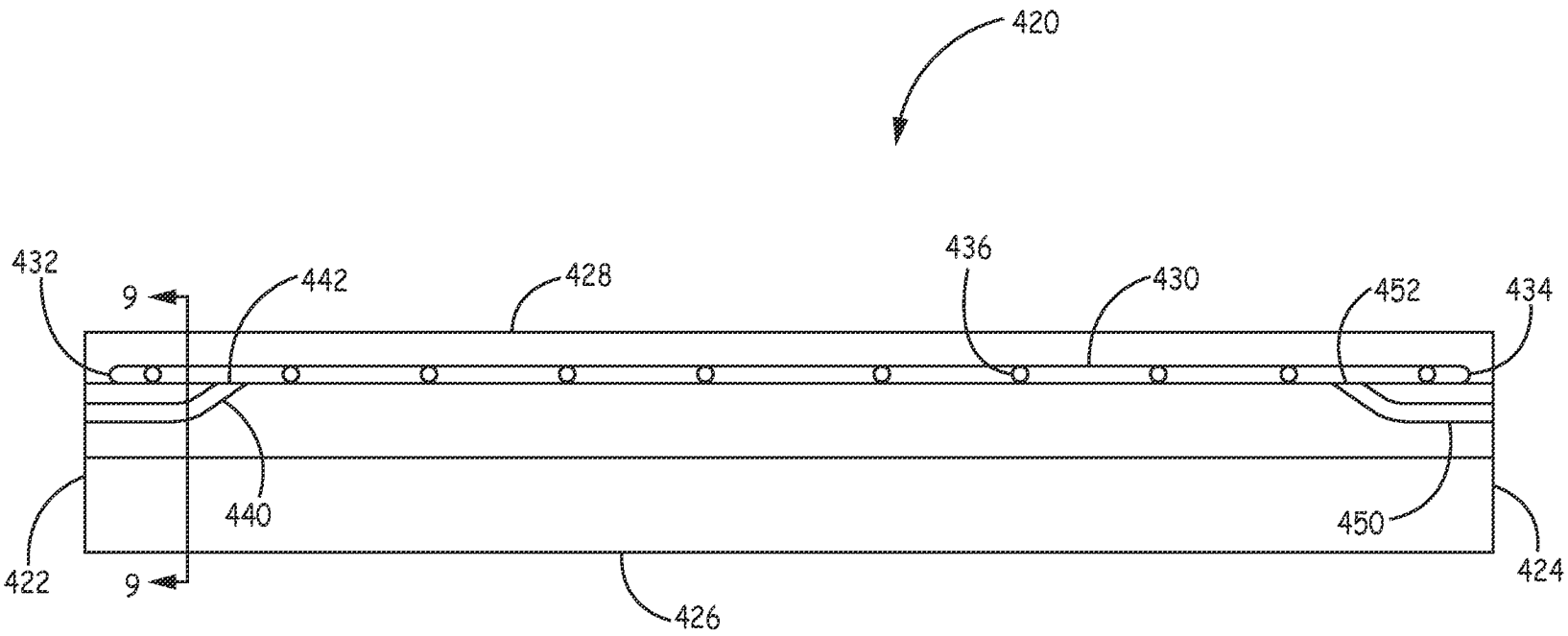
FIG. 8 is a top plan view of another illustrative embodiment of a draining sill as described herein.
Figure 9:
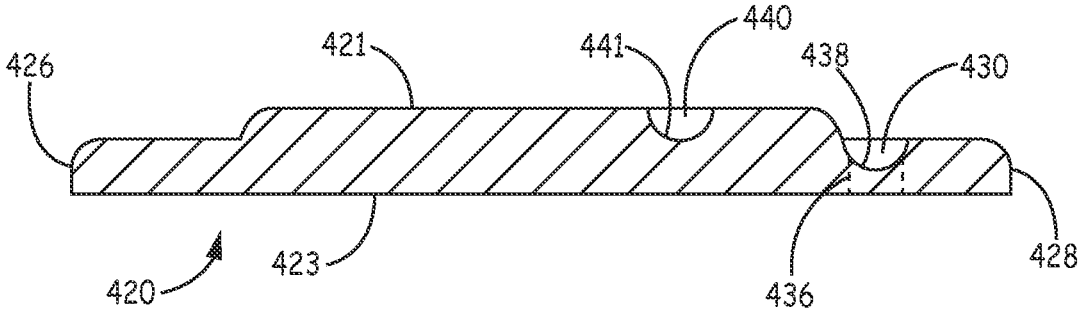
FIG. 9 is a cross-sectional view of the draining sill of FIG. 8, taken along line 9-9 in FIG. 8.

Still another illustrative embodiment of a draining sill as described herein is depicted in FIGS. 8 and 9, where FIG. 9 is a cross-sectional view of the draining sill 420 taken along line 9-9 in FIG. 8.

The draining sill 420 includes a primary drain channel 430 and a pair of auxiliary channels 440 and 450 located at opposite ends 422 and 424 of the draining sill 420. The primary drain channel 430 includes a bottom 438, while the auxiliary channel 440 includes a bottom 441. The auxiliary channel 440 terminates in an auxiliary channel terminus 442 such that fluid collected in the auxiliary channel 440 drains into the primary drain channel 430 as described herein. The second auxiliary channel 450 includes a bottom 451 and also terminates in an auxiliary channel terminus 452 such that fluid collected in the second auxiliary channel 450 drains into the primary drain channel 430 as described herein.

One difference between the draining sill 420 and the draining sills described above is that the primary drain channel 430 is formed in or on the draining sill 420 such that it terminates at a first location 432 on one end and 434 on the opposite end. Furthermore, the primary drain channel 430 is not continuous over the entire length of the draining sill 420 from the first end 422 to the second end 4242 and, therefore, does not require plugs to close the ends of the primary drain channel 430 as used in connection with, e.g., the primary drain channel 30 in draining sill 20 described above.

Another difference is that the draining sill 420 may be formed as a completely integral one-piece part as seen in the cross-sectional view of FIG. 9. In such an embodiment, the primary drain channel 430 and the auxiliary channels 440 and 450 may be formed in or on the draining sill 420 using any suitable technique or combination of techniques, e.g., milling, machining, casting, molding, etc.

Figure 10:
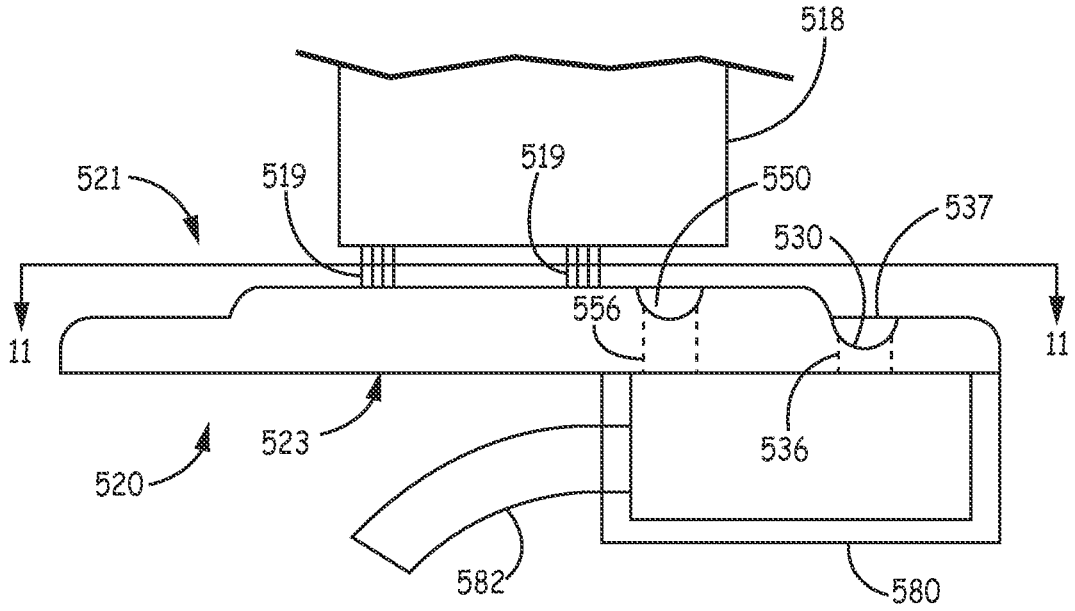
FIG. 10 is a cross-sectional view of another alternative embodiment of a draining sill as described herein with a panel located above the draining sill (with the view being taken along line 10-10 in FIG. 11).
Figure 11:
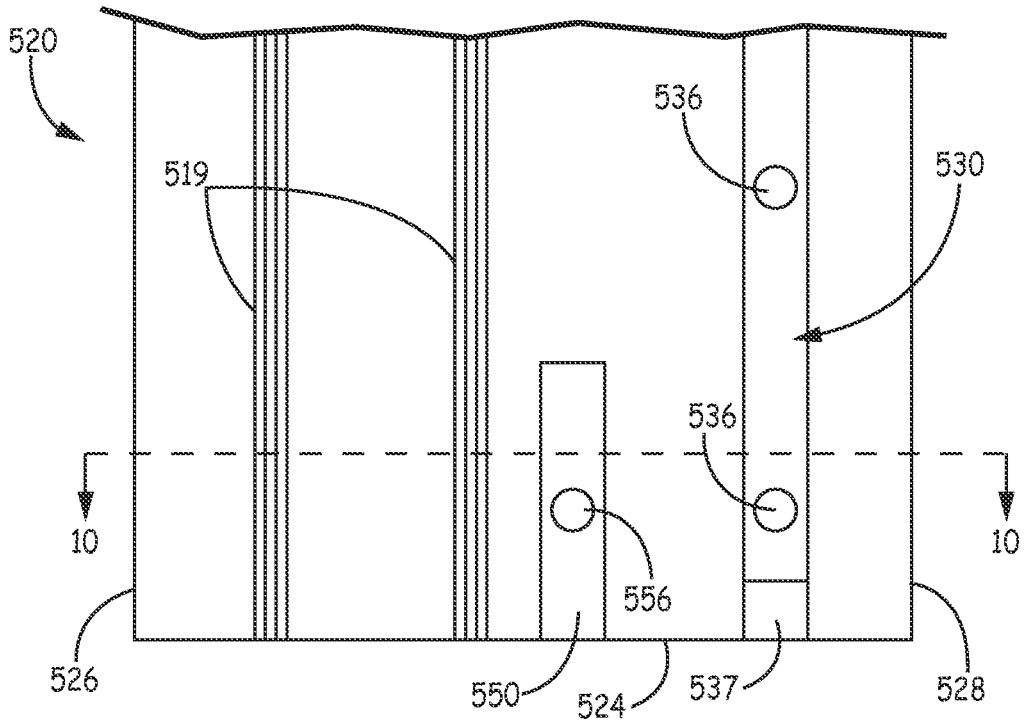
FIG. 11 is a top plan view of the draining sill of FIG. 10 taken along line 11-11 passing between the panel and the draining sill in FIG. 10.

Another illustrative embodiment of a draining sill 520 as described herein is depicted in connection with FIGS. 10 and 11. The draining sill 520 includes a top surface 521, a bottom surface 523, and exterior edge 526 and an interior edge 528, as well as a primary drain channel 530 and an auxiliary channel 550. The depicted illustrative embodiment of draining sill 520 also includes an optional collection chamber 580 drained by a drain tube 582, where the collection chamber 580 is positioned below the bottom surface 523 of the draining sill 520.

A panel 518 is positioned above the top 521 of the draining sill 520 and includes weatherstripping 519 configured to provide a seal between the panel 518 and the top 521 of the draining sill 520. In one or more embodiments, it may be preferred that the weatherstripping be located closer to the exterior edge 526 of the draining sill 520 than both auxiliary channel 550 and primary drain channel 530.

The primary drain channel 530 in the illustrative embodiment of draining sill 520 includes drain openings 536 formed therein such that water collected in the primary drain channel 530 can pass through the drain openings 536 into the collection chamber 580. The portion of the draining sill 520 depicted in FIG. 11 includes an optional end plug 537 that defines the end of the primary drain channel 530 at the end 524 of the draining sill 520 in a manner similar to the end plugs described above with respect to draining sill 20 (where the end of the primary drain channel 30 is described as either a first location or second location).

The illustrative embodiment of draining sill 520 also includes an auxiliary channel 550 that is located between the primary drain channel 530 and the exterior edge 526 of the draining sill 520. One difference between the auxiliary channel 550 and the auxiliary channels described in connection with the illustrative embodiments described above is that a drain opening 556 is located within the auxiliary channel 550 such that water collected in the auxiliary channel 550 may pass through the drain opening 556. Where an optional collection chamber 580 is located below drain opening 556, water passing through the drain opening 556 can pass into that collection chamber 580.

Although not depicted in connection with the illustrative embodiment of draining sill 520, in one or more alternative embodiments the auxiliary channel 550 may include one or more drain openings 556 and at least one auxiliary channel terminus as described in connection with the other embodiments of the auxiliary channels described herein. In an auxiliary channel that includes both one or more drain openings 556 and at least one auxiliary channel terminus, water collected in the auxiliary channel 550 can pass out of the auxiliary channel 550 either through the drain opening 556 (into, e.g., optional collection chamber 580) or through the auxiliary channel terminus into primary drain channel 530. It should be understood that one or more drain openings similar to drain opening 556 may, in one or more embodiments, be provided in connection with any of the auxiliary channels used in draining sills as described herein.

The complete disclosure of the patents, patent documents, and publications identified herein are incorporated by reference in their entirety as if each were individually incorporated. To the extent there is a conflict or discrepancy between this document and the disclosure in any such incorporated document, this document will control.

Illustrative embodiments of the draining sills, frame assemblies incorporating the same and methods are discussed herein some possible variations have been described. These and other variations and modifications in the invention will be apparent to those skilled in the art without departing from the scope of the invention, and it should be understood that this invention is not limited to the illustrative embodiments set forth herein. Accordingly, the invention is to be limited only by the claims provided below and equivalents thereof. It should also be understood that this invention also may be suitably practiced in the absence of any element not specifically disclosed as necessary herein.

What is claimed is:

1. A draining sill comprising:

a primary drain channel comprising a primary channel bottom located between a top and a bottom of the draining sill, wherein the primary drain channel extends from a first location proximate a first end of the draining sill to a second location proximate a second end of the draining sill, and wherein the primary drain channel is located between an exterior edge and an interior edge of the draining sill;

a plurality of drain openings extending through the draining sill within the primary drain channel, wherein each drain opening of the plurality of drain openings extends through the bottom of the draining sill; and a first auxiliary channel located between the exterior edge of the draining sill and the primary drain channel, wherein the first auxiliary channel terminates at a first auxiliary channel terminus configured to drain fluid in the first auxiliary channel into the primary drain channel, wherein the first auxiliary channel terminus is located between the first location of the primary drain channel and the second location of the primary drain channel, and wherein the first auxiliary channel terminus is located closer to the first end than the second end of the draining sill, and further wherein the first auxiliary channel extends from the first auxiliary channel terminus towards the first end of the draining sill.

2. A draining sill according to claim 1, wherein the first location of the primary drain channel is spaced apart from the first end of the draining sill, and wherein the first location is located between the first auxiliary channel terminus and the first end along the length of the draining sill.

3. A draining sill according to claim 1, wherein the first auxiliary channel terminus is located above the primary drain channel.

4. A draining sill according to claim 1, wherein the first auxiliary channel comprises a depth measured from the top of the draining sill that decreases when moving along the first auxiliary channel from the first auxiliary channel terminus towards the first end of the draining sill.

5. A draining sill according to claim 1, wherein the first auxiliary channel comprises a first auxiliary channel bottom, and wherein the first auxiliary channel bottom is located closer to the top of the draining sill than the primary channel bottom.

6. A draining sill according to claim 1, the draining sill further comprising a second auxiliary channel located between the exterior edge of the draining sill and the primary drain channel, wherein the second auxiliary channel terminates at a second auxiliary channel terminus configured to drain fluid in the second auxiliary channel into the primary drain channel, wherein the second auxiliary channel extends from the second auxiliary channel terminus towards the second end of the draining sill;

wherein the first auxiliary channel terminus is located between the first location of the primary drain channel and the second auxiliary channel terminus along a length of the draining sill as measured between the first end and the second end of the draining sill;

and wherein the second auxiliary channel terminus is located between the second location of the primary drain channel and the first auxiliary channel terminus along the length of the draining sill.

7. A draining sill according to claim 6, wherein the second location of the primary drain channel is spaced apart from the second end of the draining sill, and wherein the second location is located between the second auxiliary channel terminus and the second end of the draining sill along the length of the draining sill.

8. A draining sill according to claim 6, wherein the second auxiliary channel terminus is located above the primary drain channel.

9. A draining sill according to claim 6, wherein the second auxiliary channel comprises a depth measured from the top of the draining sill that decreases when moving along the second auxiliary channel from the second auxiliary channel terminus towards the second end of the draining sill.

10. A draining sill according to claim 6, wherein the second auxiliary channel comprises a second auxiliary channel bottom, and wherein the second auxiliary channel bottom is located closer to the top of the draining sill than the primary channel bottom.

11. A draining sill according to claim 6, wherein the draining sill comprises a base and a cover comprising a separate article attached to a top surface of the base, wherein the bottom of the draining sill is formed by the base, and wherein the cover forms at least a portion of the top of the draining sill, and further wherein the cover comprises an exterior cover edge and an interior cover edge, wherein the interior cover edge is located between the exterior cover edge and the interior edge of the draining sill, and still further wherein the primary drain channel is on the base and both the first auxiliary channel and the second auxiliary channel are on the cover.

12. A draining sill according to claim 6, wherein the draining sill further comprises an intermediate auxiliary channel located between the exterior edge and the primary drain channel, and wherein the intermediate auxiliary channel comprises an intermediate auxiliary channel terminus configured to drain fluid in the intermediate auxiliary channel into the primary drain channel;

wherein the intermediate auxiliary channel terminus is located between the first auxiliary channel terminus and the second auxiliary channel terminus.

13. A draining sill according to claim 12, wherein the intermediate auxiliary channel terminus is located above the primary drain channel.

14. A draining sill according to claim 12, wherein the intermediate auxiliary channel comprises a depth measured from the top of the draining sill that decreases when moving along the intermediate auxiliary channel away from the intermediate auxiliary channel terminus.

15. A draining sill according to claim 12, wherein the intermediate auxiliary channel comprises an intermediate auxiliary channel bottom, and wherein the intermediate auxiliary channel bottom is located closer to the top of the draining sill than the primary channel bottom.

16. A draining sill according to claim 12, wherein the draining sill comprises a base and a cover comprising a separate article attached to a top surface of the base, wherein the bottom of the draining sill is formed by the base, and wherein the cover forms at least a portion of the top of the draining sill, and further wherein the cover comprises an exterior cover edge and an interior cover edge, wherein the interior cover edge is located between the exterior cover edge and the interior edge of the draining sill, and still further wherein the primary drain channel on the base, and yet further wherein the first auxiliary channel, the second auxiliary channel, and the intermediate auxiliary channel are on the cover.

17. A draining sill according to claim 1, wherein the draining sill comprises a base and a cover comprising a separate article attached to a top surface of the base, wherein the bottom of the draining sill is formed by the base, and wherein the cover forms at least a portion of the top of the draining sill, and further wherein the cover comprises an exterior cover edge and an interior cover edge, wherein the interior cover edge is located between the exterior cover edge and the interior edge of the draining sill, and still further wherein the primary drain channel is on the base and the first auxiliary channel is on the cover.

18. A draining sill according to claim 17, wherein the exterior cover edge is located between exterior edge of the draining sill and the interior cover edge.

19. A draining sill according to claim 17, wherein the interior cover edge is located above the primary drain channel.

20. A draining sill according to claim 1, wherein the draining sill comprises a base and a cover comprising a separate article attached to a top surface of the base, wherein the bottom of the draining sill is formed by the base, wherein the cover comprises an exterior cover edge and an interior cover edge, wherein the interior cover edge is located between the exterior cover edge and the interior edge of the draining sill, and wherein the primary drain channel and the first auxiliary channel are both formed on the base.

21. A draining sill according to claim 1, wherein the draining sill comprises one or more collection chambers located below the bottom of the draining sill and configured to collect water passing through the plurality of drain openings.

22. A window or door frame assembly comprising a first side jamb, a second side jamb, a head jamb, a draining sill, and a first panel configured for movement relative to a frame opening formed between the first side jamb, the second side jamb, the head jamb, and the draining sill such that the first panel closes or opens at least a portion of the frame opening, wherein the draining sill comprises:

a primary drain channel comprising a primary channel bottom located between a top and a bottom of the draining sill, wherein the primary drain channel extends from a first location proximate a first end of the draining sill to a second location proximate a second end of the draining sill, and wherein the primary drain channel is located between an exterior edge and an interior edge of the draining sill;

a plurality of drain openings extending through the draining sill within the primary drain channel, wherein each drain opening of the plurality of drain openings extends through the bottom of the draining sill; and a first auxiliary channel located between the exterior edge of the draining sill and the primary drain channel, wherein the first auxiliary channel terminates at a first auxiliary channel terminus configured to drain fluid in the first auxiliary channel into the primary drain channel, wherein the first auxiliary channel terminus is located between the first location of the primary drain channel and the second location of the primary drain channel, and wherein the first auxiliary channel terminus is located closer to the first end than the second end of the draining sill, and further wherein the first auxiliary channel extends from the first auxiliary channel terminus towards the first end of the draining sill.

23. A window or door frame assembly according to claim 22, wherein the first location of the primary drain channel is spaced apart from the first end of the draining sill, and wherein the first location is located between the first auxiliary channel terminus and the first end along the length of the draining sill.

24. A window or door frame assembly according to claim 22, wherein the first auxiliary channel terminus is located above the primary drain channel.

25. A window or door frame assembly according to claim 22, wherein the first auxiliary channel comprises a depth measured from the top of the draining sill that decreases when moving along the first auxiliary channel from the first auxiliary channel terminus towards the first end of the draining sill.

26. A window or door frame assembly according to claim 22, wherein the first auxiliary channel comprises a first auxiliary channel bottom, and wherein the first auxiliary channel bottom is located closer to the top of the draining sill than the primary channel bottom.

27. A window or door frame assembly according to claim 22, wherein the draining sill further comprises:

a second auxiliary channel located between the exterior edge of the draining sill and the primary drain channel, wherein the second auxiliary channel terminates at a second auxiliary channel terminus configured to drain fluid in the second auxiliary channel into the primary drain channel, wherein the second auxiliary channel extends from the second auxiliary channel terminus towards the second end of the draining sill;

wherein the first auxiliary channel terminus is located between the first location of the primary drain channel and the second auxiliary channel terminus along the length of the draining sill;

and wherein the second auxiliary channel terminus is located between the second location of the primary drain channel and the first auxiliary channel terminus along the length of the draining sill.

28. A window or door frame assembly according to claim 27, wherein the second location of the primary drain channel is spaced apart from the second end of the draining sill, and wherein the second location is located between the second auxiliary channel terminus and the second end of the draining sill along the length of the draining sill.

29. A window or door frame assembly according to claim 27, wherein the second auxiliary channel terminus is located above the primary drain channel.

30. A window or door frame assembly according to claim 27, wherein the second auxiliary channel comprises a depth measured from the top of the draining sill that decreases when moving along the second auxiliary channel from the second auxiliary channel terminus towards the second end of the draining sill.

31. A window or door frame assembly according to claim 27, wherein the second auxiliary channel comprises a second auxiliary channel bottom, and wherein the second auxiliary channel bottom is located closer to the top of the draining sill than the primary channel bottom.

32. A window or door frame assembly according to claim 27, wherein the frame assembly comprises a second panel configured for movement relative to the frame opening such that the second panel closes or opens at least a portion of the frame opening, wherein the first panel and the second panel comprise a closed configuration in which a free edge of the first panel meets a free edge of the second panel at a junction located within the frame opening between the first and second side jambs, and wherein the draining sill further comprises:

an intermediate auxiliary channel located beneath the junction, wherein the intermediate auxiliary channel is located between the exterior edge and the primary drain channel, and wherein the intermediate auxiliary channel comprises an intermediate auxiliary channel terminus configured to drain fluid in the intermediate auxiliary channel into the primary drain channel;

wherein the intermediate auxiliary channel terminus is located between the first auxiliary channel terminus and the second auxiliary channel terminus.

33. A window or door frame assembly according to claim 32, wherein the intermediate auxiliary channel terminus is located above the primary drain channel.

34. A window or door frame assembly according to claim 32, wherein the intermediate auxiliary channel comprises a depth measured from the top of the draining sill that decreases when moving along the intermediate auxiliary channel away from the intermediate auxiliary channel terminus.

35. A window or door frame assembly according to claim 32, wherein the intermediate auxiliary channel comprises an intermediate auxiliary channel bottom, and wherein the intermediate auxiliary channel bottom is located closer to the top of the draining sill than the primary channel bottom.

36. A window or door frame assembly according to claim 22, wherein the draining sill comprises a base and a cover comprising a separate article attached to a top surface of the base, wherein the bottom of the draining sill is formed by the base, and wherein the cover forms at least a portion of the top of the draining sill, and further wherein the cover comprises an exterior cover edge and an interior cover edge, wherein the interior cover edge is located between the exterior cover edge and the interior edge of the draining sill, and still further wherein the primary drain channel is on base and the first auxiliary channel is on the cover.

37. A window or door frame assembly according to claim 36, wherein the interior cover edge is located above the primary drain channel.

38. A window or door frame assembly according to claim 22, wherein the draining sill comprises a base and a cover comprising a separate article attached to a top surface of the base, wherein the bottom of the draining sill is formed by the base, wherein the cover comprises an exterior cover edge and an interior cover edge, wherein the interior cover edge is located between the exterior cover edge and the interior edge of the draining sill, and wherein the primary drain channel and the first auxiliary channel are both formed on the base.

39. A window or door frame assembly according to claim 22, wherein the draining sill comprises one or more collection chambers located below the bottom of the draining sill and configured to collect water passing through the plurality of drain openings.

* * * * *